US010691049B2

(12) United States Patent
Fujimoto et al.

(10) Patent No.: US 10,691,049 B2
(45) Date of Patent: Jun. 23, 2020

(54) FIXING DEVICE AND IMAGE FORMING APPARATUS

(71) Applicants: Ippei Fujimoto, Kanagawa (JP); Hiroyuki Shimada, Tokyo (JP); Yoshiki Yamaguchi, Kanagawa (JP); Takashi Seto, Kanagawa (JP); Takayuki Seki, Kanagawa (JP)

(72) Inventors: Ippei Fujimoto, Kanagawa (JP); Hiroyuki Shimada, Tokyo (JP); Yoshiki Yamaguchi, Kanagawa (JP); Takashi Seto, Kanagawa (JP); Takayuki Seki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/419,068

(22) Filed: May 22, 2019

(65) Prior Publication Data

US 2020/0033777 A1 Jan. 30, 2020

(30) Foreign Application Priority Data

Jul. 25, 2018 (JP) ..... 2018-139207

(51) Int. Cl.
*G03G 15/20* (2006.01)

(52) U.S. Cl.
CPC ..... *G03G 15/2057* (2013.01); *G03G 15/2053* (2013.01); *G03G 15/2064* (2013.01)

(58) Field of Classification Search
CPC ..... G03G 15/2057; G03G 15/2064; G03G 15/2032; G03G 15/2053; G03G 15/2007; G03G 15/2042
See application file for complete search history.

(56) References Cited

U.S. PATENT DOCUMENTS

2011/0044734 A1 2/2011 Shimokawa et al.
2012/0121304 A1 5/2012 Tokuda et al.
(Continued)

FOREIGN PATENT DOCUMENTS

JP 2007-114698 5/2007
JP 2009-276368 11/2009
(Continued)

OTHER PUBLICATIONS

U.S. Appl. No. 16/239,948, filed Jan. 4, 2019, Yoshiki Yamaguchi, et al.

*Primary Examiner* — Hoang X Ngo
(74) *Attorney, Agent, or Firm* — Harness, Dickey & Pierce, P.L.C.

(57) ABSTRACT

A fixing device includes a fixing rotator and a pressure rotator that is disposed opposite the fixing rotator. A nip former is disposed inside a loop formed by the fixing rotator and disposed opposite the pressure rotator via the fixing rotator to form a fixing nip between the fixing rotator and the pressure rotator. The fixing rotator slides over the nip former. A flange supports the fixing rotator at both lateral ends of the fixing rotator in a longitudinal direction of the fixing rotator. The nip former includes a base and a thermal conductor that has a thermal conductivity greater than a thermal conductivity of the base. The base is greater than the thermal conductor in the longitudinal direction of the fixing rotator. The base includes a groove that is disposed outboard at least from the thermal conductor in the longitudinal direction of the fixing rotator.

19 Claims, 6 Drawing Sheets

(56) References Cited

U.S. PATENT DOCUMENTS

| | | | | |
|---|---|---|---|---|
| 2012/0155936 | A1 | 6/2012 | Yamaguchi et al. | |
| 2014/0079453 | A1 | 3/2014 | Arai et al. | |
| 2015/0055994 | A1 | 2/2015 | Shoji et al. | |
| 2015/0110531 | A1 | 4/2015 | Takagi et al. | |
| 2015/0125193 | A1 | 5/2015 | Ishii et al. | |
| 2015/0261157 | A1 | 9/2015 | Yamano et al. | |
| 2015/0268597 | A1 | 9/2015 | Arai et al. | |
| 2016/0154350 | A1 | 6/2016 | Saito et al. | |
| 2016/0161890 | A1 | 6/2016 | Shoji et al. | |
| 2016/0187823 | A1 | 6/2016 | Seto et al. | |
| 2016/0223961 | A1 | 8/2016 | Takagi et al. | |
| 2016/0231672 | A1* | 8/2016 | Seto | G03G 15/2053 |
| 2016/0274514 | A1 | 9/2016 | Ishii et al. | |
| 2017/0176899 | A1 | 6/2017 | Okamoto et al. | |
| 2017/0176906 | A1 | 6/2017 | Sawada et al. | |
| 2017/0176907 | A1 | 6/2017 | Sawada et al. | |
| 2017/0185009 | A1 | 6/2017 | Yoshinaga et al. | |
| 2017/0185015 | A1 | 6/2017 | Yoshinaga et al. | |
| 2017/0185020 | A1 | 6/2017 | Seki et al. | |
| 2017/0185021 | A1 | 6/2017 | Seki et al. | |
| 2017/0255147 | A1* | 9/2017 | Seki | G03G 15/2053 |
| 2017/0261900 | A1 | 9/2017 | Sawada et al. | |
| 2017/0364000 | A1 | 12/2017 | Seki et al. | |
| 2018/0011432 | A1 | 1/2018 | Yoshinaga et al. | |
| 2018/0017910 | A1 | 1/2018 | Sawada et al. | |
| 2018/0157198 | A1 | 6/2018 | Seto et al. | |
| 2018/0284663 | A1 | 10/2018 | Matsuda et al. | |
| 2018/0284669 | A1 | 10/2018 | Fujimoto et al. | |
| 2018/0335733 | A1 | 11/2018 | Matsuda et al. | |
| 2018/0356754 | A1 | 12/2018 | Yoshinaga et al. | |

FOREIGN PATENT DOCUMENTS

| | | |
|---|---|---|
| JP | 2011-043666 | 3/2011 |
| JP | 2017-009944 | 1/2017 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-139207, filed on Jul. 25, 2018, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses are requested to meet an increasing market demand for energy saving and high speed printing.

The image forming apparatuses form a toner image on a recording medium such as a recording sheet, printing paper, photosensitive paper, and electrostatic recording paper by an indirect transfer method or a direct transfer method through image forming processes of electrophotographic recording, electrostatic recording, magnetic recording, or the like. The image forming apparatuses employ fixing devices that fix an unfixed toner image on the recording medium by a contact heating method such as a roller heating method, a film heating method, and an electromagnetic heating method.

For example, the fixing devices include a fixing device using a belt, a fixing device using a ceramic heater, and a fixing device using a halogen heater that heats a fixing belt directly, thus saving energy.

In the fixing devices employing the ceramic heater and the halogen heater, respectively, an inner circumferential surface of the fixing belt slides over a nip forming pad. To address this circumstance, a lubricant is applied between the inner circumferential surface of the fixing belt and the nip forming pad. However, the lubricant (e.g., grease) having a decreased viscosity may leak from a lateral end of the fixing belt in an axial direction thereof, causing failure. For example, the leaked lubricant may flow onto a surface of each of the fixing belt and a pressure roller, decreasing friction between the surface of the fixing belt and the surface of the pressure roller. Accordingly, as a recording medium bearing a toner image is conveyed through a fixing nip formed between the fixing belt and the pressure roller, the recording medium may slip over the fixing belt and the pressure roller and may be jammed or oil contained in the lubricant may adhere to the toner image on the recording medium, resulting in formation of a faulty toner image.

SUMMARY

This specification describes below an improved fixing device. In one embodiment, the fixing device includes a fixing rotator that is formed into a loop and rotatable. A pressure rotator is disposed opposite the fixing rotator and rotatable. A nip former is disposed inside the loop formed by the fixing rotator and disposed opposite the pressure rotator via the fixing rotator to form a fixing nip between the fixing rotator and the pressure rotator. The fixing rotator slides over the nip former. A flange supports the fixing rotator at both lateral ends of the fixing rotator in a longitudinal direction of the fixing rotator. The nip former includes a base and a thermal conductor that has a thermal conductivity greater than a thermal conductivity of the base. The base is greater than the thermal conductor in the longitudinal direction of the fixing rotator. The base includes a groove that is disposed outboard at least from the thermal conductor in the longitudinal direction of the fixing rotator.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
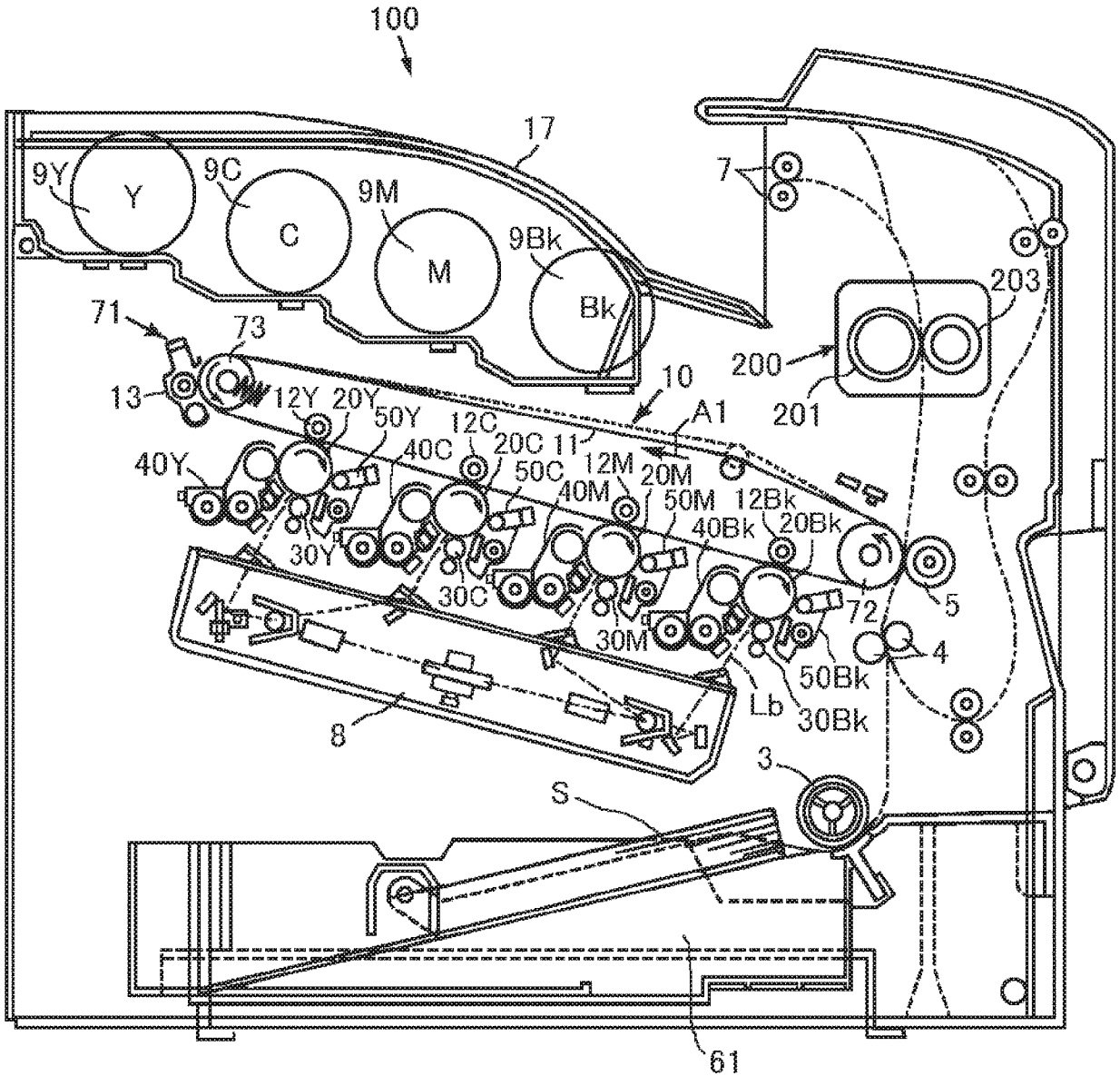
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to FIG. 1, the following describes a construction of an image forming apparatus 100 according to an embodiment of the present disclosure.

The image forming apparatus 100 illustrated in FIG. 1 is a color printer employing a tandem system in which a plurality of image forming devices that forms images in a plurality of colors, respectively, is aligned in a stretch direction of a transfer belt 11. Alternatively, the image forming apparatus 100 may employ systems other than the tandem system. According to this embodiment, the image forming apparatus 100 is a printer. Alternatively, the image forming apparatus 100 may be a copier, a facsimile machine, or a multifunction peripheral (MFP) having at least two of copying, facsimile, printing, scanning, and plotter functions.

The image forming apparatus 100 employs the tandem system in which photoconductive drums 20Y, 20C, 20M, and 20Bk are aligned. The photoconductive drums 20Y, 20C, 20M, and 20Bk serve as image hearers that bear images in yellow, cyan, magenta, and black as color separation components, respectively.

In the image forming apparatus 100, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt that moves in a direction A1 while the transfer belt 11 is disposed opposite the photoconductive drums 20Y, 20C, 20M, and 20Bk. In the primary transfer process, yellow, cyan, magenta, and black toner images are transferred onto the transfer belt 11 such that the yellow, cyan, magenta, and black toner images are superimposed on the transfer belt 11. Thereafter, the visible images formed on the transfer belt 11 are transferred collectively onto a recording medium S (e.g., a recording sheet) in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk that forms the black toner image as an example, a charger 30Bk, a developing device 40Bk, a primary transfer roller 12Bk, and a cleaner 50Bk which form the black toner image are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y 50C, and 50M are disposed in a rotation direction of the photoconductive drums 20Y, 20C, and 20M, respectively. An optical writing device 8 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. The primary transfer rollers 12Y, 12C, 12M, and 12Bk disposed opposite the photoconductive drums 20Y 20C, 20M, and 20Bk via the transfer belt 11 apply voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from upstream to downstream in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 5, a belt cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 is disposed opposite the transfer belt 11 and rotates in accordance with rotation of the transfer belt 11. The belt cleaner 13 is disposed opposite the transfer belt 11 and cleans the transfer belt 11. The optical writing device 8 is disposed opposite and below the four imaging stations.

The optical writing device 8 includes a semiconductor laser serving as a light source, a coupling lens, an f-θ lens, a toroidal lens, a reflection mirror, and a polygon mirror serving as a deflector. The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the light beam Lb directed to the imaging station that forms the black toner image, the light beams Lb are also directed to the imaging stations that form the yellow, cyan, and magenta toner images, respectively.

The image forming apparatus 100 further includes a sheet feeder 61, a registration roller pair 4, and a sensor. The sheet feeder 61 is a sheet feeding tray (e.g., a paper tray) that loads recording media S to be conveyed to a secondary transfer nip formed between the secondary transfer roller 5 and the transfer belt 11. The registration roller pair 4 feeds the recording medium S conveyed from the sheet feeder 61 to the secondary transfer nip formed between the secondary transfer roller 5 and the transfer belt 11 at a predetermined time when the yellow, cyan, magenta, and black toner images formed on the transfer belt 11 by the imaging stations reach the secondary transfer nip. The sensor detects that a leading edge of the recording medium S reaches the registration roller pair 4.

The image forming apparatus 100 further includes a fixing device 200, a sheet ejection roller pair 7, a sheet ejection tray 17, and toner bottles 9Y, 9C, 9M, and 9Bk. The fixing device 200 is a fuser unit that fixes a color toner image on the recording medium S in a belt fixing method. The color toner image is formed by transferring the yellow, cyan, magenta, and black toner images formed on the transfer belt 11 onto the recording medium S. The sheet ejection roller pair 7 ejects the recording medium S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording media S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. Hence, the driven roller 73 includes a biasing member such as a spring. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording medium S. As the sheet feeding roller 3 is driven and rotated counterclockwise in FIG. 1, the sheet feeding roller 3 feeds the uppermost recording medium S to the registration roller pair 4.

The belt cleaner 13 installed in the transfer device 71, although the belt cleaner 13 is schematically illustrated in FIG. 1, includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11.

The belt cleaner 13 further includes a discharging device that conveys the residual toner removed from the transfer belt 11 for disposal.

A description is provided of a construction of the fixing device 200 according to a first embodiment of the present disclosure, that is incorporated in the image forming apparatus 100.

Figure 2:
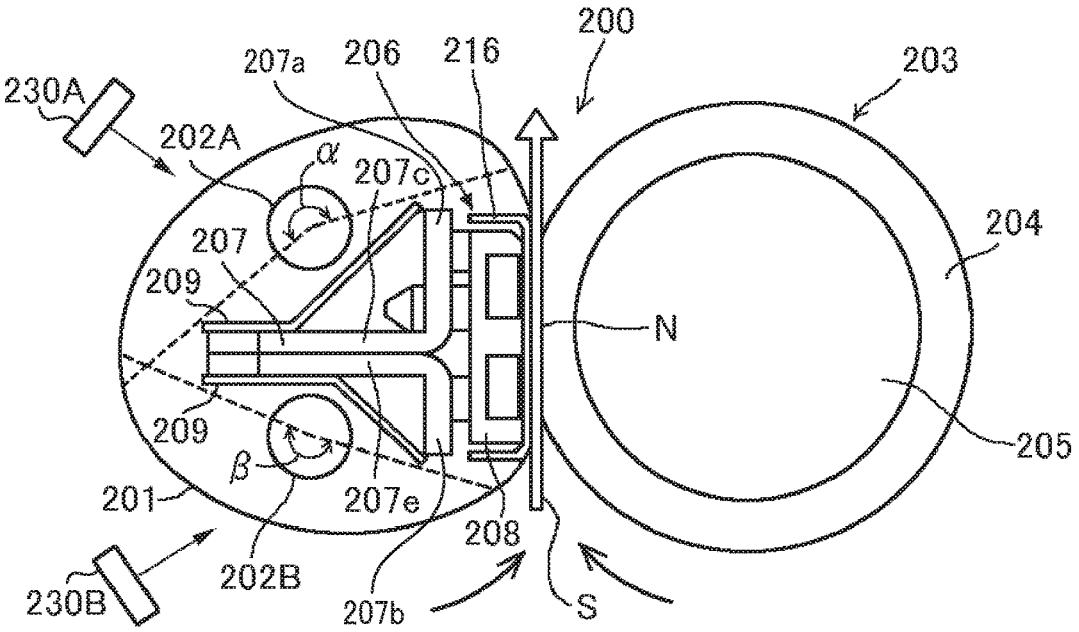
FIG. 2 is a schematic cross-sectional view of a fixing device according to a first embodiment of the present disclosure, that is incorporated in the image forming apparatus depicted in FIG. 1.

FIG. 2 is a schematic cross-sectional view of the fixing device 200 according to the first embodiment.

The fixing device 200 includes a fixing belt 201 and a pressure roller 203. The fixing belt 201 serves as a fixing rotator or a fixing member that is rotatable in a rotation direction indicated by an arrow in FIG. 2. The pressure roller 203 serves as a pressure rotator or a pressure member that is disposed opposite the fixing belt 201 and rotatable in a rotation direction indicated by an arrow in FIG. 2, Halogen heaters 202A and 202B serve as a plurality of heat sources or heaters that is disposed opposite an inner circumferential surface of the fixing belt 201. The halogen heaters 202A and 202B heat the fixing belt 201 directly with radiant heat. Temperature sensors 230A and 230B are disposed opposite an outer circumferential surface of the fixing belt 201. The temperature sensors 230A and 230B detect the temperature of the fixing belt 201 without contacting the fixing belt 201. A controller controls a lighting rate of the halogen heaters 202A and 202B based on temperatures of the fixing belt 201 that are detected by the temperature sensors 230A and 230B, respectively, thus adjusting the temperature of the fixing belt 201 to a desired temperature. The temperature sensors 230A and 230B are disposed opposite the halogen heaters 202A and 202B, respectively, so that the temperature sensors 230A and 230B readily detect temperatures of heated portions of the fixing belt 201, that are heated by the halogen heaters 202A and 202B, respectively.

A nip forming pad 206, serving as a nip former, is disposed inside a loop formed by the fixing belt 201. The nip forming pad 206 presses against the pressure roller 203 via the fixing belt 201 to form a fixing nip N between the fixing belt 201 and the pressure roller 203. The inner circumferential surface of the fixing belt 201 slides over the nip forming pad 206 such that the fixing belt 201 slides over a thermal conduction aid 216 mounted on a base 208 incorporated in the nip forming pad 206. As a recording medium S bearing a toner image is conveyed through the fixing nip N, the fixing belt 201 and the pressure roller 203 fix the toner image on the recording medium S under heat and pressure. The nip forming pad 206 includes the base 208 and the thermal conduction aid 216 serving as a thermal conductor that has a thermal conductivity greater than a thermal conductivity of the base 208.

The base 208 is made of resin that has an increased mechanical strength and an increased heat resistance, for example, liquid crystalline polyester. Accordingly, the base 208 is immune from thermal deformation in a toner fixing temperature range in which the toner image is fixed on the recording medium S, stabilizing the fixing nip N and quality of the toner image output on the recording medium S.

As illustrated in FIG. 2, an opposed face of the thermal conduction aid 216, that is disposed opposite the inner circumferential surface of the fixing belt 201, serves as a nip forming face that contacts the fixing belt 201 directly. The nip forming face of the thermal conduction aid 216 is planar. Alternatively, the nip forming face of the thermal conduction aid 216 may be curved or concave or may have other shapes. If the nip forming face of the thermal conduction aid 216 is concave to define the fixing nip N that is concave, the leading edge of the recording medium S is directed to the pressure roller 203 when the recording medium S is ejected from the fixing nip N, facilitating separation of the recording medium S from the fixing belt 201 and thereby preventing the recording medium S from being jammed.

A surface of the thermal conduction aid 216, that is, the nip forming face that contacts the inner circumferential surface of the fixing belt 201, is treated with a coating that facilitates sliding of the fixing belt 201 over the thermal conduction aid 216, thus reducing friction and abrasion of the fixing belt 201. As the coating that facilitates sliding, a fluorine coating having a decreased friction or a material having an increased abrasion resistance such as diamond-like carbon (DLC) is used.

The fixing device 200 includes the nip forming pad 206 and a stay 207 that are disposed inside the loop formed by the fixing belt 201. The nip forming pad 206 is disposed opposite the pressure roller 203. The stay 207 supports the nip forming pad 206 against pressure from the pressure roller 203.

The thermal conduction aid 216 covers an opposed face of the base 208, that is disposed opposite the inner circumferential surface of the fixing belt 201. The thermal conduction aid 216 prevents heat generated by the halogen heater 202B serving as a lateral end heater from being stored locally. The thermal conduction aid 216 facilitates conduction of heat in a longitudinal direction, that is, an axial direction, of the fixing belt 201 and decreases unevenness of the temperature of the fixing belt 201 in the longitudinal direction thereof. The halogen heater 202B serves as a lateral end heater that includes a filament at both lateral end spans of the halogen heater 202B in a longitudinal direction thereof parallel to the axial direction of the fixing belt 201. The halogen heater 202A serves as a center heater that includes a filament at a center span of the halogen heater 202A in a longitudinal direction thereof parallel to the axial direction of the fixing belt 201.

The thermal conduction aid 216 serving as a thermal conductor or an increased thermal conductivity member is preferably made of a material that conducts heat in a shortened time period. The thermal conduction aid 216 is preferably made of a material having an increased thermal conductivity, for example, metal such as copper having a thermal conductivity of 398 W/mk, aluminum having a thermal conductivity of 236 W/mk, and silver. Copper is most preferable by comprehensively considering costs, availability, thermal conductivity, and processing.

A detailed description is now given of a construction of the fixing belt 201.

The fixing belt 201 is an endless belt or film made of metal such as nickel and SUS stainless steel or resin such as polyimide. The fixing belt 201 includes a base layer and a release layer. The release layer serves as a surface layer made of tetrafluoroethylene-perfluoroalkylvinylether copolymer (PFA), polytetrafluoroethylene (PTFE), or the like. The release layer facilitates separation of the recording medium S from the fixing belt 201 and prevents toner from adhering to the fixing belt 201. Optionally, an elastic layer made of silicone rubber or the like may be interposed between the base layer and the release layer. If the fixing belt 201 does not incorporate the elastic layer, the fixing belt 201 attains a decreased thermal capacity that improves fixing property of being heated quickly. However, when the pressure roller 203 presses and deforms an unfixed toner image to fix the toner image on the recording medium S, slight surface asperities of the fixing belt 201 may be transferred onto the toner image, causing a disadvantage that an orange peel mark remains on a solid part of the toner image as variation in gloss of the toner image or an orange peel image. To address this circumstance, the elastic layer has a thickness of 100 micrometers or greater. As the elastic layer deforms, the elastic layer absorbs the slight surface asperities, preventing the orange peel mark on the toner image.

A detailed description is now given of a construction of the stay 207.

The stay 207 includes bases 207*a* and 207*b* and arms 207*c* and 207*e* that project from the bases 207*a* and 207*b*, respectively. The arms 207*c* and 207*e* are disposed opposite the fixing nip N via the bases 207*a* and 207*b*. The halogen heater 202A serving as a fixing heater is disposed opposite the halogen heater 202B serving as a fixing heater via the arms 207*c* and 207*e*. The halogen heaters 202A and 202B disposed opposite the inner circumferential surface of the fixing belt 201 heat the fixing belt 201 directly with radiant heat. The halogen heaters 202A and 202B are not surrounded by the stay 207. That is, a center of each of the halogen heaters 202A and 202B is outside a space surrounded by the stay 207. Hence, irradiation angles $\alpha$ and $\beta$ with which the halogen heaters 202A and 202B irradiate the fixing belt 201 are obtuse angles, respectively, improving heating efficiency of heating the fixing belt 201.

The nip forming pad 206 and the stay 207 serving as a support that supports the nip forming pad 206 to define the fixing nip N are disposed inside the loop formed by the fixing belt 201. The stay 207 prevents the nip forming pad 206 from being bent by pressure from the pressure roller 203, attaining a uniform length of the fixing nip N in a recording medium conveyance direction throughout the entire width of the fixing belt 201 in the axial direction thereof. Both ends of the stay 207 in the axial direction of the fixing belt 201 are supported by and secured to flanges 300 depicted in FIG. 3, serving as holders, thus being positioned inside the loop formed by the fixing belt 201. A reflector 209 is interposed between the stay 207 and each of the halogen heaters 202A and 202B. The reflectors 209 reflect radiant heat and the like from the halogen heaters 202A and 202B, suppressing heating of the stay 207 with radiant heat and the like and resultant waste of energy. Instead of the reflectors 209, a surface of the stay 207 may be treated with insulation or mirror finish to attain similar advantages.

As illustrated in FIG. 2, the reflectors 209 are interposed between the halogen heaters 202A and 202B to prevent the halogen heaters 202A and 202B from heating glass tubes thereof each other, causing the halogen heaters 202A and 202B to heat the fixing belt 201 effectively.

A detailed description is now given of a construction of the pressure roller 203.

The pressure roller 203 includes a cored bar 205, an elastic rubber layer 204, and a release layer. The elastic rubber layer 204 is disposed on the cored bar 205. The release layer serves as a surface layer that facilitates separation of the recording medium S from the pressure roller 203. The release layer is made of PFA, PTFE, or the like. A driving force is transmitted to the pressure roller 203 from a driver such as a motor disposed in the image forming apparatus 100 through a gear, thus rotating the pressure roller 203. A spring or the like presses the pressure roller 203 against the fixing belt 201. As the spring presses and deforms the elastic rubber layer 204, the pressure roller 203 forms the fixing nip N having a predetermined length in the recording medium conveyance direction. The pressure roller 203 may be a solid roller or a hollow roller. Alternatively, a heater such as a halogen heater may be disposed inside the pressure roller 203. The elastic rubber layer 204 may be made of solid rubber. Alternatively, if no heater is disposed inside the pressure roller 203, sponge rubber may be used. The sponge rubber enhances thermal insulation of the pressure roller 203, preferably causing the pressure roller 203 to draw less heat from the fixing belt 201.

The fixing belt 201 rotates in accordance with rotation of the pressure roller 203. With the construction of the fixing device 200 illustrated in FIG. 2, as the driver drives and rotates the pressure roller 203, the driving force is transmitted from the pressure roller 203 to the fixing belt 201 at the fixing nip N, rotating the fixing belt 201 in accordance with rotation of the pressure roller 203. The fixing belt 201 rotates while the nip forming pad 206 and the pressure roller 203 sandwich the fixing belt 201 at the fixing nip N. The fixing belt 201 rotates while the flanges 300 depicted in FIG. 3 guide the fixing belt 201 at both lateral ends of the fixing belt 201 in the axial direction thereof in a circumferential span of the fixing belt 201 other than the fixing nip N.

With the construction described above, the fixing device 200 attaining quick warmup is manufactured at reduced costs.

Figure 3:
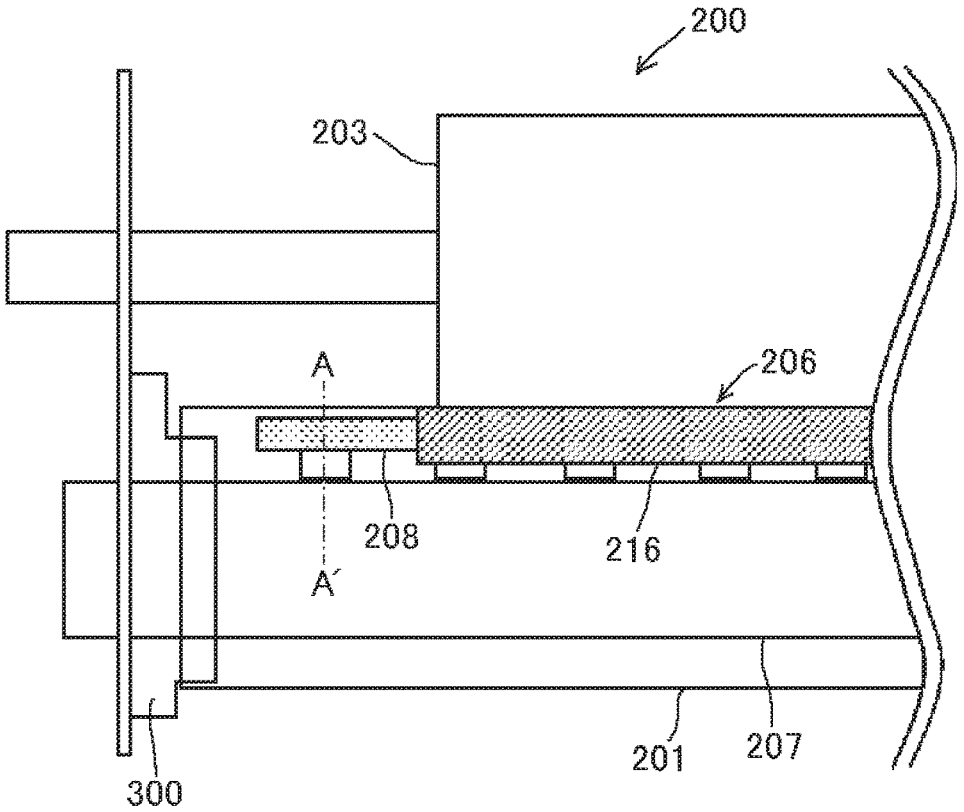
FIG. 3 is a schematic cross-sectional view of the fixing device depicted in FIG. 2, illustrating one lateral end of the fixing device in an axial direction of a fixing belt incorporated therein.

Referring to FIG. 3, a description is provided of a positional relation between the thermal conduction aid 216, the base 208, and the flange 300.

FIG. 3 is a schematic cross-sectional view of the fixing device 200, illustrating one lateral end of the fixing device 200 in the axial direction of the fixing belt 201.

Each of the base 208, the thermal conduction aid 216, and the stay 207 extends in the axial direction of the fixing belt 201. The axial direction is hereinafter referred to as the longitudinal direction.

For example, a length of the pressure roller 203 in a longitudinal direction thereof is designed to be greater than a maximum conveyance span where a maximum recording medium S is conveyed through the fixing device 200 in case a user shifts or skews the recording medium S. According to this embodiment, the maximum conveyance span is 320 mm. A length of the thermal conduction aid 216 is designed to be greater than the length of the pressure roller 203 in the longitudinal direction thereof. It is because, if the thermal conduction aid 216 is smaller than the pressure roller 203 in the longitudinal direction thereof, the fixing belt 201 may be bent and damaged by both lateral ends of the thermal conduction aid 216 in a longitudinal direction thereof at the fixing nip N. Additionally, in view of mounting backlash, the thermal conduction aid 216 is designed to be greater than the pressure roller 203 in the longitudinal direction thereof. The flanges 300 that support the fixing belt 201 mount the fixing belt 201 at both lateral ends of the fixing belt 201 in the longitudinal direction thereof, respectively. The flange 300 is separated from an edge face of the pressure roller 203 with a predetermined distance therebetween. Thus, stress imposed on the fixing belt 201 decreases. The base 208 is greater than the thermal conduction aid 216 in the longitudinal direction thereof and is separated from the flange 300 disposed at the lateral end of the fixing belt 201 in the longitudinal direction thereof.

A description is provided of a construction of a first comparative fixing device, a second comparative fixing device, and a third comparative fixing device.

In the first comparative fixing device, a lubricant is applied between a fixing belt and a nip forming pad. However, the lubricant (e.g., grease) having a decreased viscosity may leak from a lateral end of the fixing belt in an axial direction thereof, causing failure. To address this circumstance, a groove is disposed on an end face of a flange that contacts an inner surface of the fixing belt at both lateral ends of the fixing belt to support the fixing belt. The groove holds the lubricant leaked from the fixing belt. In the second comparative fixing device, a scraper is disposed on a surface of the fixing belt at both lateral ends of the fixing belt. In the first comparative fixing device, the groove collects the lubricant and a lubricant collector holds the lubricant leaked from the lateral end of the fixing belt, preventing a surface of each of the fixing belt and a pressure roller and a recording medium from being stained.

The lubricant may not prevent abrasion of parts while the inner surface of the fixing belt slides over the nip forming pad. Accordingly, abrasion powder may generate from the inner surface of the fixing belt or the nip forming pad, resulting in formation of a faulty toner image. To address this circumstance, the third comparative fixing device includes a scraper that scrapes the abrasion powder off the fixing belt.

However, as the abrasion powder adheres to the flange, frictional resistance between the flange and the fixing belt may increase, imposing torsional stress on a lateral end of the fixing belt and damaging the lateral end of the fixing belt. For example, the abrasion powder generates in a slide region of a fixing nip where the fixing belt slides over the nip forming pad. The abrasion powder is mixed with the lubricant and moved to both lateral ends of the fixing belt, reaching the flanges. A narrow gap is produced in a rubbing region where the inner surface of the fixing belt rubs a surface of the flange. Accordingly, the abrasion powder having a decreased flowability does not move from the gap and remains in the gap in a state in which the abrasion powder adheres to the surface of the flange. Consequently, the abrasion powder may increase load imposed on the fixing belt while the inner surface of the fixing belt slides over the surface of the flange, damaging both lateral ends of the fixing belt.

To address this circumstance, before the lubricant containing the abrasion powder reaches the flange, it is requested to collect the lubricant to prevent the lubricant from adhering to the flange.

Figure 4:
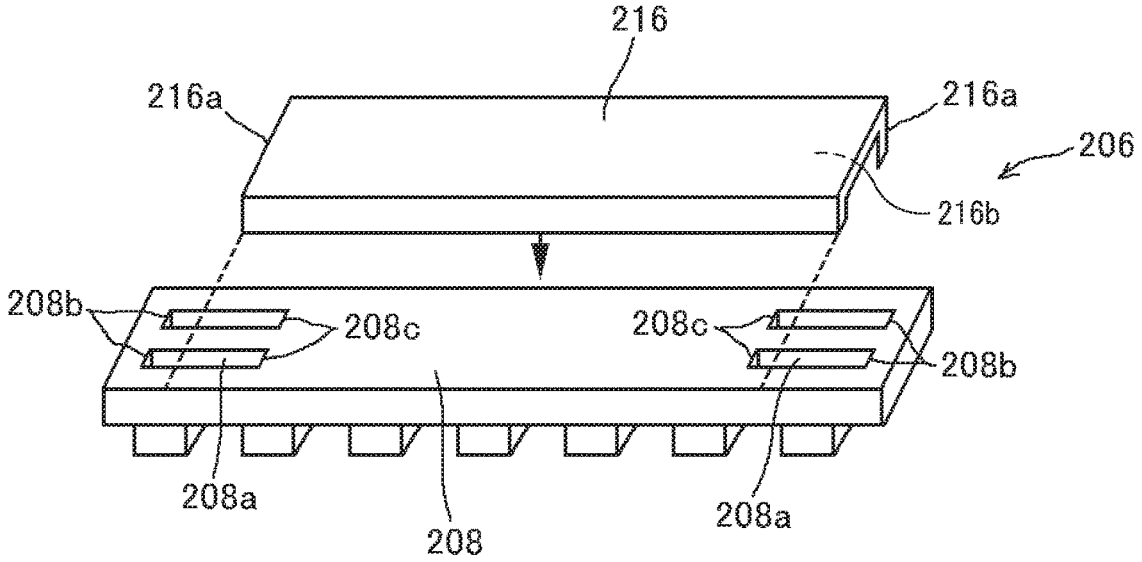
FIG. 4 is a schematic perspective view of a nip forming pad incorporated in the fixing device depicted in FIG. 2, illustrating a base and a thermal conduction aid of the nip forming pad.

Referring to FIG. 4, a description is provided of the shape of a groove of the nip forming pad 206.

FIG. 4 is a schematic perspective view of the base 208 and the thermal conduction aid 216 of the nip forming pad 206.

As illustrated in FIG. 4, the nip forming pad 206 includes grooves 208*a* aligned in two lines. The grooves 208*a* hold abrasion powder or a lubricant containing abrasion powder that is leaked from the thermal conduction aid 216. The grooves 208*a* are disposed on both lateral ends of the base 208 in a longitudinal direction thereof. Each of the grooves 208*a* extends straight in the longitudinal direction of the base 208. The groove 208*a* is rectangular in cross section in a direction perpendicular to the longitudinal direction of the base 208. However, the shape of the groove 208*a* in cross section is not limited to a rectangle. The groove 208*a* may be other polygons. For example, the groove 208*a* may be pentagonal in cross section. The lubricant is applied between the thermal conduction aid 216 and the inner circumferential surface of the fixing belt 201.

As described above, the base 208 of the nip forming pad 206 is greater than the thermal conduction aid 216 in the longitudinal direction thereof. The length of the groove 208*a* is set such that the groove 208*a* protrudes beyond the thermal conduction aid 216 in the longitudinal direction thereof when the thermal conduction aid 216 mounted on the base 208 is installed in the fixing device 200. For example, the base 208 includes the groove 208*a* disposed at least outboard from the thermal conduction aid 216 in the longitudinal direction thereof. The groove 208*a* holds the lubricant. The groove 208*a* disposed outboard from the thermal conduction aid 216 in the longitudinal direction thereof extends to a back face 216*b* of the thermal conduction aid 216, that faces the base 208. More specifically, an edge portion 216*a* of the thermal conduction aid 216 is disposed outboard from an inboard edge portion 208*c* of the groove 208*a* and is disposed inboard from an outboard edge portion 208*b* of the groove 208*a* in the longitudinal direction of the thermal conduction aid 216. Hence, in the fixing device 200, the groove 208*a* collects the abrasion powder or the lubricant containing the abrasion powder that generates in a slide portion of the fixing nip N where the fixing belt 201 slides over the thermal conduction aid 216. Accordingly, the groove 208*a* prevents the abrasion powder from adhering to the flange 300. Consequently, frictional resistance does not increase, preventing a failure that both lateral ends of the fixing belt 201 in the axial direction thereof suffer from damage or breakage.

The abrasion powder contains a rigid component such as metal filler. Hence, even when the abrasion powder adheres to the inner circumferential surface of the fixing belt 201 and circulates on the fixing belt 201, the abrasion powder may damage the inner circumferential surface of the fixing belt 201 and the surface of the thermal conduction aid 216, causing formation of a faulty toner image with streaks and the like. To address this circumstance, the groove 208*a* collects the abrasion powder, preventing the failures described above.

The position of the inboard edge portion 208*c* of the groove 208*a* is set properly. For example, the inboard edge portion 208*c* may be closer to a center of the base 208 in the longitudinal direction thereof. As the groove 208*a* is disposed more inboard under the thermal conduction aid 216 in the longitudinal direction thereof, the groove 208*a* adjusts an amount of the lubricant or the abrasion powder that is leaked from the thermal conduction aid 216 and held by the groove 208*a* according to an amount (e.g., a length) of the groove 208*a* that extends under the thermal conduction aid 216 in the longitudinal direction thereof.

According to this embodiment, the base 208 of the nip forming pad 206 includes the grooves 208*a* aligned in two lines. Alternatively, the base 208 may include the grooves 208*a* aligned in three lines or more. As the capacity of the groove 208*a* increases, the amount of the lubricant or the abrasion powder that is held by the groove 208*a* increases advantageously. However, as the width of the groove 208*a* in a short direction of the base 208 increases, the base 208 is susceptible to bending, causing adjustment of the strength of the base 208.

Figure 5:
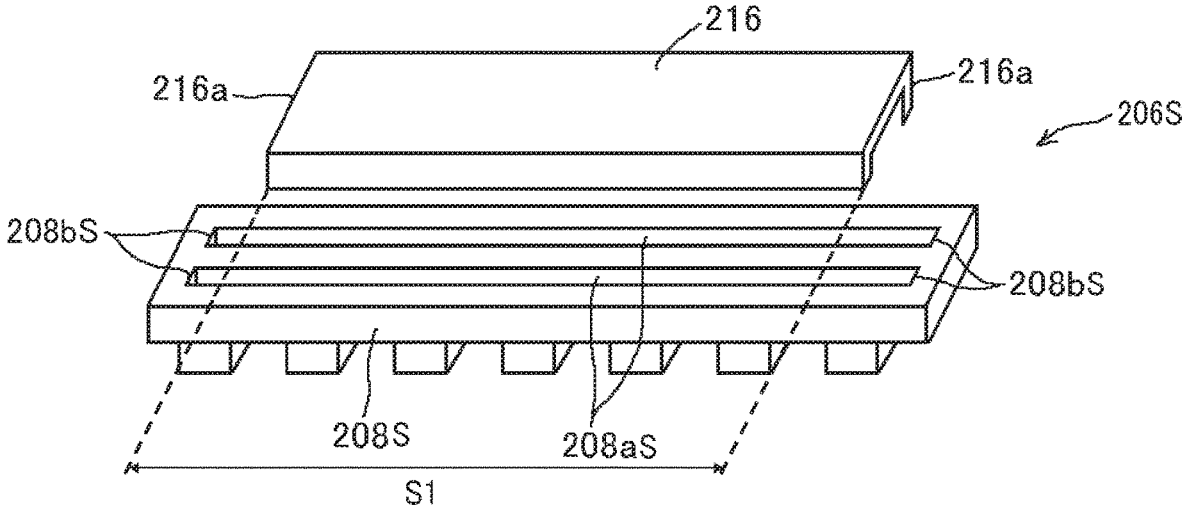
FIG. 5 is a schematic perspective view of a nip forming pad including a base and the thermal conduction aid as a variation of the nip forming pad depicted in FIG. 4.

Referring to FIG. 5, a description is provided of alternative shapes of the groove 208*a* of the nip forming pad 206.

FIG. 5 is a schematic perspective view of a base 208S and the thermal conduction aid 216 of a nip forming pad 206S.

As illustrated in FIG. 5, the nip forming pad 206S includes grooves 208*a*S aligned in two lines. The grooves 208*a*S hold the abrasion powder or the lubricant containing the abrasion powder that is leaked from the thermal conduction aid 216. The grooves 208*a*S are continuous in a longitudinal direction of the base 208S in a covered span S1 of the base 208S where the base 208S is covered by the thermal conduction aid 216. Each of the grooves 208*a*S extends straight in the longitudinal direction of the base 208S. The groove 208*a*S is rectangular in cross section in a direction perpendicular to the longitudinal direction of the base 208S. However, the shape of the groove 208*a*S in cross section is not limited to a rectangle. The groove 208*a*S may be other polygons. For example, the groove 208*a*S may be pentagonal in cross section.

According to this embodiment, like the nip forming pad 206 depicted in FIG. 4, the length of the groove 208*a*S is set such that the groove 208*a*S protrudes beyond the thermal conduction aid 216 in the longitudinal direction thereof when the thermal conduction aid 216 mounted on the base 208S is installed in the fixing device 200. For example, the base 208S includes the groove 208*a*S disposed outboard at least from the thermal conduction aid 216 in the longitudinal direction thereof. The groove 208*a*S holds the lubricant. More specifically, the edge portion 216*a* of the thermal conduction aid 216 is disposed inboard from an outboard edge portion 208*b*S of the groove 208*a*S in the longitudinal direction of the thermal conduction aid 216.

Hence, in the fixing device 200, the groove 208*a*S collects the abrasion powder or the lubricant containing the abrasion powder that generates in the slide portion of the fixing nip N where the fixing belt 201 slides over the thermal conduction aid 216. Accordingly, the groove 208*a*S prevents the abrasion powder from adhering to the flange 300. Consequently, frictional resistance does not increase, preventing a failure that both lateral ends of the fixing belt 201 in the axial direction thereof suffer from damage or breakage.

According to this embodiment, covered portions of the grooves 208*a*S aligned in two lines, that are covered by the thermal conduction aid 216, hold the abrasion powder or the lubricant containing the abrasion powder. The abrasion powder or the lubricant containing the abrasion powder that accumulates in an outboard portion of the groove 208*a*S of the base 208S, that is disposed outboard from the thermal conduction aid 216 in the longitudinal direction of the base 208S, moves through the groove 208*a*S and also flows into the covered portion of the base 208S, that is covered by thermal conduction aid 216. Although a mechanical strength of the base 208S depicted in FIG. 5 is smaller than a mechanical strength of the base 208 depicted in FIG. 4, a thermal capacity of the base 208S is smaller than a thermal capacity of the base 208, saving energy further.

Figure 6:
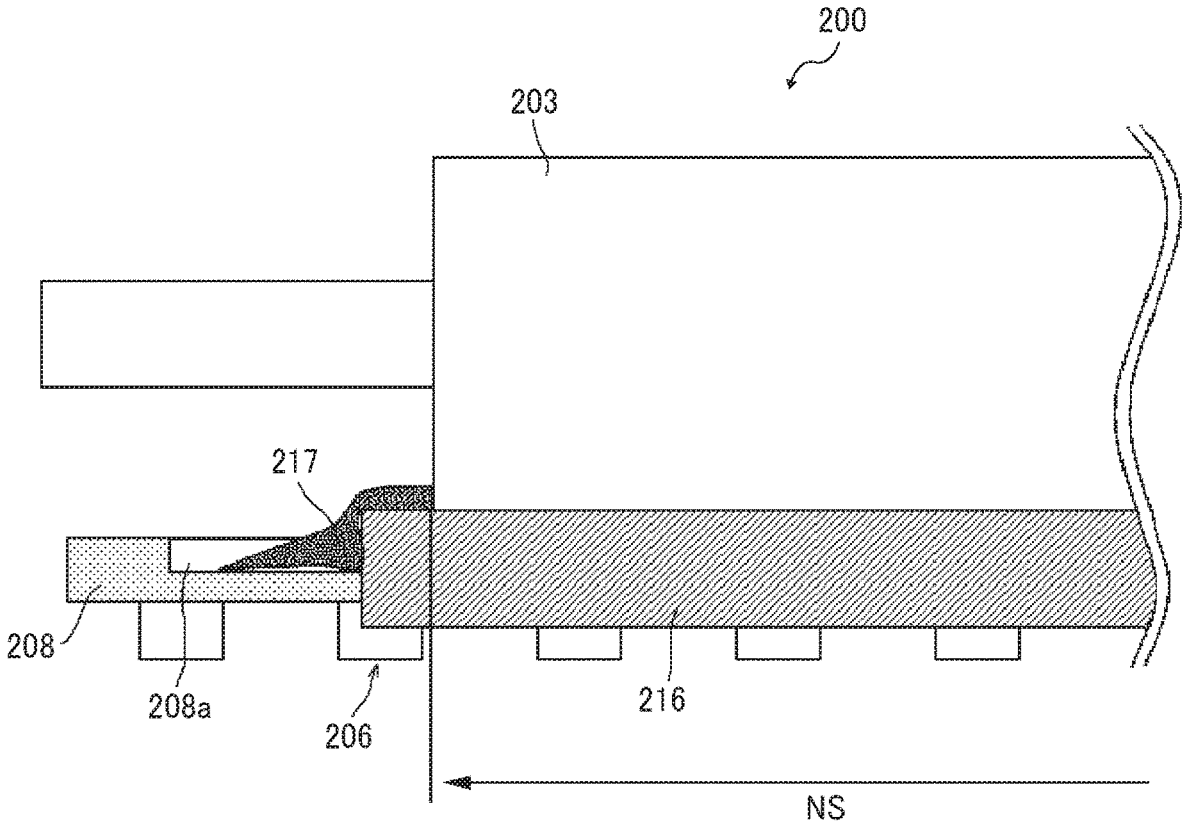
FIG. 6 is a schematic diagram of the fixing device depicted in FIG. 3, illustrating a lubricant accumulated in a groove of the nip forming pad.

FIG. 6 is a diagram of the fixing device 200, illustrating the lubricant containing the abrasion powder accumulated in the groove 208*a* of the nip forming pad 206.

A pressing span where the pressure roller 203 is pressed against the thermal conduction aid 216 defines a fixing nip span NS of the fixing nip N in the longitudinal direction of the pressure roller 203. A lubricant 217 (e.g., grease) is pressed toward an outside of the fixing nip span NS, that is, each lateral end of the base 208 in the longitudinal direction thereof. Initially, the lubricant 217 accumulates on the thermal conduction aid 216. When an amount of the lubricant 217 that is pressed onto the thermal conduction aid 216 increases, the lubricant 217 is bulged out beyond the thermal conduction aid 216 onto the base 208. The lubricant 217 is accumulated and stored in the groove 208*a* of the base 208.

If the base 208 is not provided with the groove 208*a*, the lubricant 217 adheres to a surface of the base 208 initially. However, thereafter, the lubricant 217 spreads over the base 208 in a direction perpendicular to a drawing sheet surface illustrated with FIG. 6, that is, a direction perpendicular to the longitudinal direction of the base 208. The lubricant 217 drops off the base 208 and adheres to the inner circumferential surface of the fixing belt 201 again. Thereafter, the lubricant 217 reaches the flange 300, increasing load imposed between the flange 300 and the fixing belt 201 while the fixing belt 201 slides over the nip forming pad 206. If the lubricant 217 adheres to the halogen heaters 202A and 202B, not to the inner circumferential surface of the fixing belt 201, the halogen heaters 202A and 202B at a high temperature vaporize the lubricant 217, causing a stench and the like.

To address this circumstance, preferably, the groove 208*a* precisely receives and stores the lubricant 217 leaked from the thermal conduction aid 216.

Figure 7A:
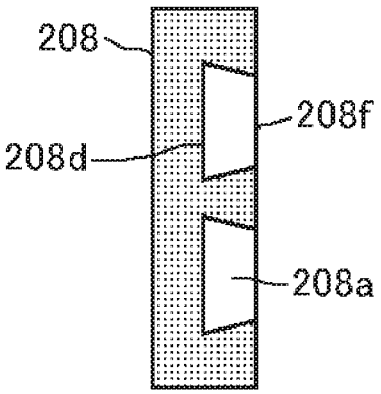
FIG. 7A is a schematic cross-sectional view of the base depicted in FIG. 4 as a first example.
Figure 7B:
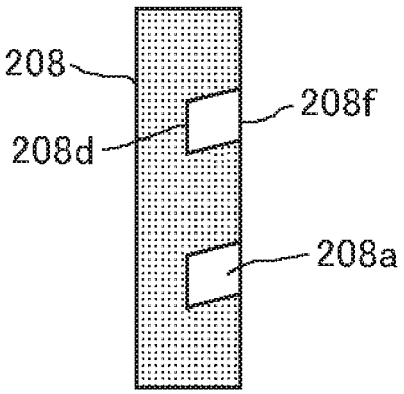
FIG. 7B is a schematic cross-sectional view of the base depicted in FIG. 4 as a second example.

FIG. 7A is a schematic cross-sectional view of the base 208 as a first example. FIG. 7B is a schematic cross-sectional view of the base 208 as a second example.

As illustrated in FIG. 7A, the groove 208*a* of the base 208 is trapezoidal in cross section. A bottom side 208*d* of the groove 208*a* is greater than a top side 208*f* of the groove 208*a* and extended lower than the top side 208*f*. As illustrated in FIG. 7B, the groove 208*a* of the base 208 is rhombic in cross section. The bottom side 208*d* of the groove 208*a* is extended lower than the top side 208*f* of the groove 208*a*. Accordingly, the groove 208*a* prevents the abrasion powder or the lubricant containing the abrasion powder that accumulates in the groove 208*a* from dropping down vertically.

A description is provided of a construction of a fixing device 200S according to a second embodiment of the present disclosure.

Figure 8:
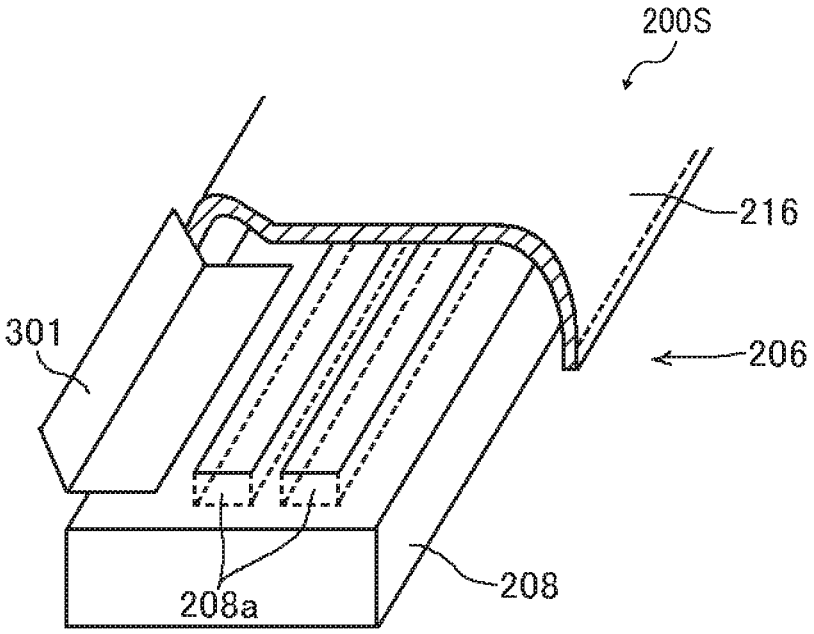
FIG. 8 is a schematic perspective view of a fixing device according to a second embodiment of the present disclosure, that is installable in the image forming apparatus depicted in FIG. 1.

FIG. 8 is a schematic perspective view of the fixing device 200S according to the second embodiment.

According to the second embodiment, the base 208 of the nip forming pad 206 mounts a Mylar® 301. The Mylar® 301 is disposed outboard from the thermal conduction aid 216 in the longitudinal direction thereof and disposed at an exit of the fixing nip N. The Mylar® 301 serves as a scraper that scrapes the abrasion powder or the lubricant containing the abrasion powder off the inner circumferential surface of the fixing belt 201. As illustrated in FIG. 8, the Mylar® 301 is disposed outboard from the fixing nip N in the longitudinal direction of the base 208 and is adjacent to the grooves 208*a*. The Mylar® 301 is attached to a downstream portion of the base 208 in the rotation direction of the fixing belt 201 with an adhesive, adhesive tape, or the like. The abrasion powder or the lubricant containing the abrasion powder that is scraped by the Mylar® 301 accumulates in the grooves 208*a*.

Figure 9:
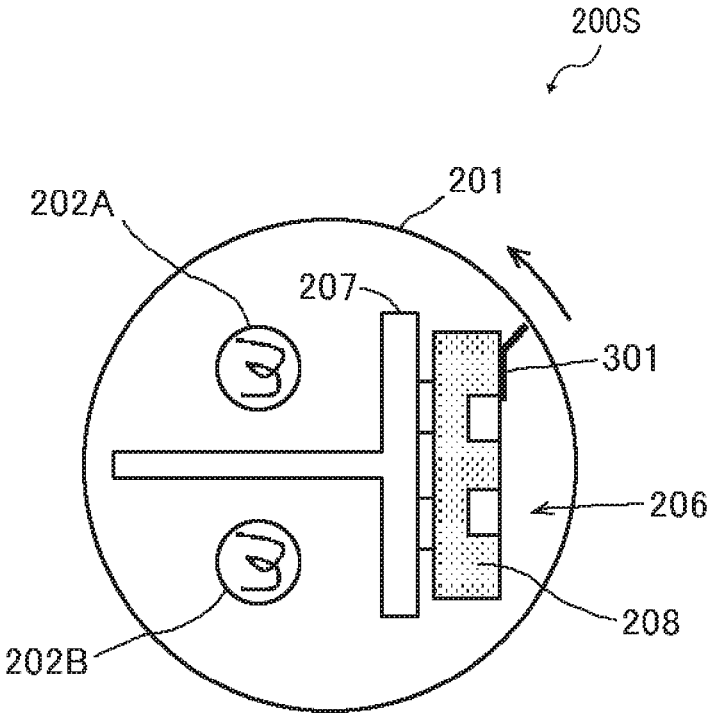
FIG. 9 is a schematic diagram of the fixing device depicted in FIG. 8, illustrating the nip forming pad seen on a cross section A-A' in FIG. 3.

FIG. 9 is a schematic diagram of the fixing device 200S, illustrating the nip forming pad 206 seen on a cross section A-A' in FIG. 3.

The Mylar® 301 contacts the inner circumferential surface of the fixing belt 201, scrapes the lubricant mixed with the abrasion powder adhered to the inner circumferential surface of the fixing belt 201, and collects the lubricant into the grooves 208*a*. Accordingly, the Mylar® 301 scrapes the lubricant containing the abrasion powder before the lubricant moves over both lateral ends of the fixing belt 201 in the longitudinal direction thereof, in a state in which the lubricant adheres to the inner circumferential surface of the fixing belt 201, and reaches the flanges 300.

The third comparative fixing device described above employs the scraper that scrapes the abrasion powder. However, if the scraper is attached such that the scraper is disposed opposite the fixing belt throughout the entire span of the fixing belt in the longitudinal direction thereof, the scraper may increase torque. It is conceived that the scraper scrapes not only the abrasion powder but also the lubricant, decreasing an amount of the lubricant applied between the fixing belt and a thermal conduction aid and thereby increasing friction with which the fixing belt slides over the thermal conduction aid. To address this circumstance, in the fixing device 200S according to the second embodiment depicted in FIG. 8, the Mylar® 301 is attached to the base 208 in an outboard span thereof that is outboard from the fixing nip N in the longitudinal direction of the base 208. The fixing belt 201 does not slide over the pressure roller 203 in the outboard span of the base 208. The Mylar® 301 scrapes the lubricant in the outboard span of the base 208.

As described above, according to the embodiments described above, each of the bases 208 and 208S made of resin is greater than the thermal conduction aid 216 made of metal in the longitudinal direction of the bases 208 and 208S. The grooves 208*a* and 208*a*S are disposed on the bases 208 and 208S, respectively, and disposed outboard from the thermal conduction aid 216 in the longitudinal direction thereof. The grooves 208*a* and 208*a*S receive the lubricant containing the abrasion powder. Thus, the grooves 208*a* and 208*a*S store the abrasion powder precisely. Accordingly, the grooves 208*a* and 208*a*S prevent the abrasion powder from adhering to the flange 300 and causing frictional resistance between the flange 300 and the fixing belt 201. Additionally, the grooves 208*a* and 208*a*S prevent the abrasion powder from remaining on the inner circumferential surface of the fixing belt 201 and damaging parts of the fixing devices 200 and 200S.

A description is provided of advantages of a fixing device (e.g., the fixing devices 200 and 200S).

As illustrated in FIGS. 2, 3, 4, 5, and 9, the fixing device includes a fixing rotator (e.g., the fixing belt 201), a pressure rotator (e.g., the pressure roller 203), a nip former (e.g., the nip forming pads 206 and 206S), and a flange (e.g., the flange 300). The fixing rotator is formed into a loop and rotatable. The pressure rotator is disposed opposite the fixing rotator and rotatable. The nip former is disposed inside the loop formed by the fixing rotator and disposed opposite the pressure rotator via the fixing rotator to form a fixing nip (e.g., the fixing nip N) between the fixing rotator and the pressure rotator. The fixing rotator slides over the nip former. A lubricant is applied between the nip former and an inner circumferential surface of the fixing rotator. The flange supports the fixing rotator at both lateral ends of the fixing rotator in a longitudinal direction thereof. The fixing rotator and the pressure rotator fix a toner image on a recording medium (e.g., the recording medium S) conveyed through the fixing nip. The nip former includes a base (e.g., the bases 208 and 208S) and a thermal conductor (e.g., the thermal conduction aid 216) that has a thermal conductivity greater than a thermal conductivity of the base. The base is greater than the thermal conductor in the longitudinal direction of the fixing rotator. The base includes a groove (e.g., the grooves 208*a* and 208*a*S) disposed outboard at least from the thermal conductor in the longitudinal direction of the fixing rotator. The groove holds abrasion powder that generates as the fixing rotator slides over the nip former or the lubricant containing the abrasion powder.

Accordingly, the groove prevents the abrasion powder that generates in a slide portion of the fixing nip where the fixing rotator slides over the nip former from adhering to the flange. Consequently, frictional resistance between the fixing rotator and the flange does not increase, preventing a failure that both lateral ends of the fixing rotator in the longitudinal direction thereof suffer from damage or breakage.

According to the embodiments described above, the fixing belt 201 serves as a fixing rotator. Alternatively, a fixing film, a fixing sleeve, or the like may be used as a fixing rotator. Further, the pressure roller 203 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing rotator being formed into a loop and being rotatable;

a pressure rotator being disposed opposite the fixing rotator and being rotatable;

a nip former, disposed inside the loop formed by the fixing rotator and disposed opposite the pressure rotator via the fixing rotator, to form a fixing nip between the fixing rotator and the pressure rotator, the fixing rotator being configured to slide over the nip former; and a flange to support the fixing rotator at both lateral ends of the fixing rotator in a longitudinal direction of the fixing rotator, the nip former including:

a base; and a thermal conductor having a thermal conductivity greater than a thermal conductivity of the base, the base being greater than the thermal conductor in the longitudinal direction of the fixing rotator, the base including a groove disposed outboard at least from the thermal conductor in the longitudinal direction of the fixing rotator, wherein the groove is configured to hold one of abrasion powder, generatable as the fixing rotator slides over the nip former, and a lubricant containing the abrasion powder, the lubricant being for application between the nip former and an inner circumferential surface of the fixing rotator.

2. The fixing device according to claim 1, further comprising a scraper mounted on the base and disposed outboard from the thermal conductor in the longitudinal direction of the fixing rotator, the scraper to scrape the one of the abrasion powder and the lubricant containing the abrasion powder.

3. The fixing device according to claim 2,
wherein the scraper contacts the inner circumferential surface of the fixing rotator.

4. The fixing device according to claim 1,
wherein the groove extends to a back face of the thermal conductor, the back face facing the base.

5. The fixing device according to claim 1,
wherein the groove is disposed on a lateral end of the base in the longitudinal direction of the fixing rotator.

6. The fixing device according to claim 1,
wherein the groove is continuous in the longitudinal direction of the fixing rotator in a covered span of the base where the base is covered by the thermal conductor.

7. The fixing device according to claim 1,
wherein the base is separated from the flange.

8. The fixing device according to claim 1,
wherein the thermal conductor contacts an inner circumferential surface of the fixing rotator and is made of metal.

9. The fixing device according to claim 8,
wherein the thermal conductor is made of one of copper and aluminum.

10. The fixing device according to claim 8,
wherein the base supports the thermal conductor and is made of resin.

11. The fixing device according to claim 10,
wherein the base is made of liquid crystalline polyester.

12. The fixing device according to claim 1,
wherein the groove is one of rectangular, pentagonal, rhombic and trapezoidal in cross section.

13. The fixing device according to claim 12,
wherein a bottom side of the groove is extended lower than a top side of the groove.

14. An image forming apparatus comprising:
an image bearer to bear an image; and
a fixing device to fix the image on a recording medium, the fixing device including:
a fixing rotator being formed into a loop and rotatable;
a pressure rotator being disposed opposite the fixing rotator and rotatable;
a nip former disposed inside the loop formed by the fixing rotator and disposed opposite the pressure rotator via the fixing rotator to form a fixing nip between the fixing rotator and the pressure rotator, the fixing rotator being configured to slide over the nip former; and
a flange to support the fixing rotator at both lateral ends of the fixing rotator in a longitudinal direction of the fixing rotator,
the nip former including:
a base; and
a thermal conductor having a thermal conductivity greater than a thermal conductivity of the base,
the base being greater than the thermal conductor in the longitudinal direction of the fixing rotator,
the base including a groove disposed outboard at least from the thermal conductor in the longitudinal direction of the fixing rotator, wherein the groove is configured to hold one of abrasion powder, generatable as the fixing rotator slides over the nip former, and a lubricant containing the abrasion powder, the lubricant being for application between the nip former and an inner circumferential surface of the fixing rotator.

15. The image forming apparatus according to claim 14,
wherein the groove is one of rectangular, pentagonal, rhombic and trapezoidal in cross section.

16. The image forming apparatus according to claim 15,
wherein a bottom side of the groove is extended lower than a top side of the groove.

17. A fixing device comprising:
a fixing rotator being formed into a loop and being rotatable;
a pressure rotator being disposed opposite the fixing rotator and being rotatable;
a nip former, disposed inside the loop formed by the fixing rotator and disposed opposite the pressure rotator via the fixing rotator, to form a fixing nip between the fixing rotator and the pressure rotator, the fixing rotator being configured to slide over the nip former; and
a flange to support the fixing rotator at both lateral ends of the fixing rotator in a longitudinal direction of the fixing rotator,
the nip former including:
a base; and
a thermal conductor having a thermal conductivity greater than a thermal conductivity of the base,
the base being greater than the thermal conductor in the longitudinal direction of the fixing rotator,
the base including a groove disposed outboard at least from the thermal conductor in the longitudinal direction of the fixing rotator, wherein the groove is at least one of trapezoidal and rhombic in cross section.

18. The fixing device according to claim 17,
wherein a bottom side of the groove is extended lower than a top side of the groove.

19. An image forming apparatus comprising:
an image bearer to bear an image; and
the fixing device of claim 17, to fix the image on a recording medium.

* * * * *